United States Patent [19]

Johansson

[11] Patent Number: 4,491,105

[45] Date of Patent: Jan. 1, 1985

[54] ARRANGEMENT IN AN I.C. ENGINE

[75] Inventor: Rolf A. G. Johansson, Partille, Sweden

[73] Assignee: AB Electrolux Motor Aktiebolag, Huskvarna, Sweden

[21] Appl. No.: 477,267

[22] Filed: Mar. 21, 1983

[30] Foreign Application Priority Data

Mar. 22, 1982 [SE] Sweden ..... 8201805

[51] Int. Cl.[3] ..... F02P 9/00; F02P 11/00

[52] U.S. Cl. ..... 123/335; 123/198 DC; 123/630

[58] Field of Search ..... 123/335, 630, 599, 339, 123/198 DC, 179 C; 30/381

[56] References Cited

U.S. PATENT DOCUMENTS

| | | | |
|---|---|---|---|
| 3,845,847 | 11/1974 | Camp | 123/198 DC |
| 4,079,708 | 3/1978 | Wieland et al. | 123/198 DC |
| 4,088,110 | 5/1978 | Sperline | 123/630 |
| 4,297,977 | 11/1981 | Boyama | 123/335 |
| 4,336,778 | 6/1982 | Howard | 123/335 |
| 4,385,601 | 5/1983 | Orova et al. | 123/335 |
| 4,404,940 | 9/1983 | Sieja | 123/335 |
| 4,409,938 | 10/1983 | Fujimoto et al. | 123/335 |

*Primary Examiner*—Raymond A. Nelli
*Attorney, Agent, or Firm*—Alfred E. Miller

[57] ABSTRACT

The invention relates to limiting of the r.p.m. on start of a power tool. At the same time the throttle control is locked in a starting position by a retaining member, a circuit in the ignition system is switched in to prevent ignition at an r.p.m. higher than the switching r.p.m. of the centrifugal clutch. The tool thus remains at low speeds during starting.

5 Claims, 3 Drawing Figures

ARRANGEMENT IN AN I.C. ENGINE

This invention relates to an arrangement in an internal combustion engine for controlling the r.p.m. on start up of the engine. The arrangement is adapted for use in combination with a centrifugal clutch that is provided on the engine shaft and having a higher switching r.p.m. than the controlled r.p.m. of the engine after start-up.

When starting power hand tools, for instance power chain saws, a throttle control is locked in a starting position. This causes the tool to start racing during the starting period. This involves a risk of accident since the operator has poor control of on start-up tool during the start. In order to decrease the risk of accident, manufacturers recommend several procedures on the start, e.g. that the operator holds the tool between his legs or against the ground. However, these rules are not always followed and sometimes injuries occur. It is therefore important to provide an arrangement which eliminates the risk of the tool hurting the operator during start-up.

The present invention provides an arrangement which operates in such a way that, at the same time that the throttle control is locked in starting position, a circuit of the ignition system is switched in and prevents ignition at an r.p.m. above the switching r.p.m. of the centrifugal clutch. When the arrangement is applied to a power saw the chain will be at rest during start-up.

Figure 1:
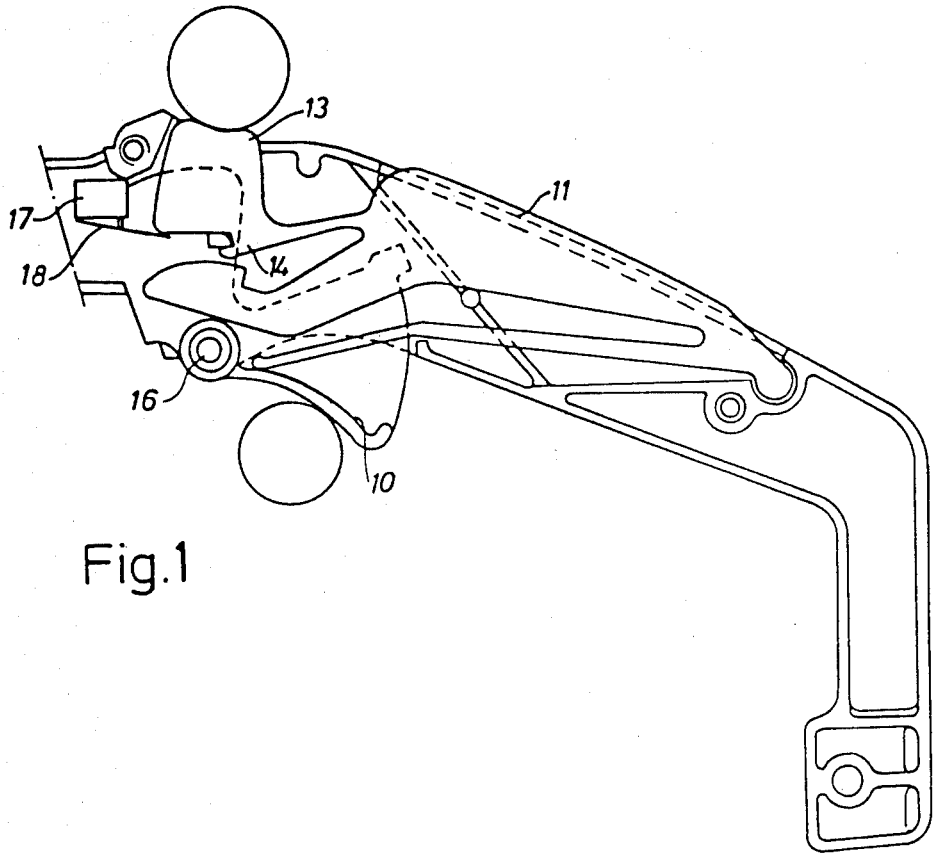
Figure 3:
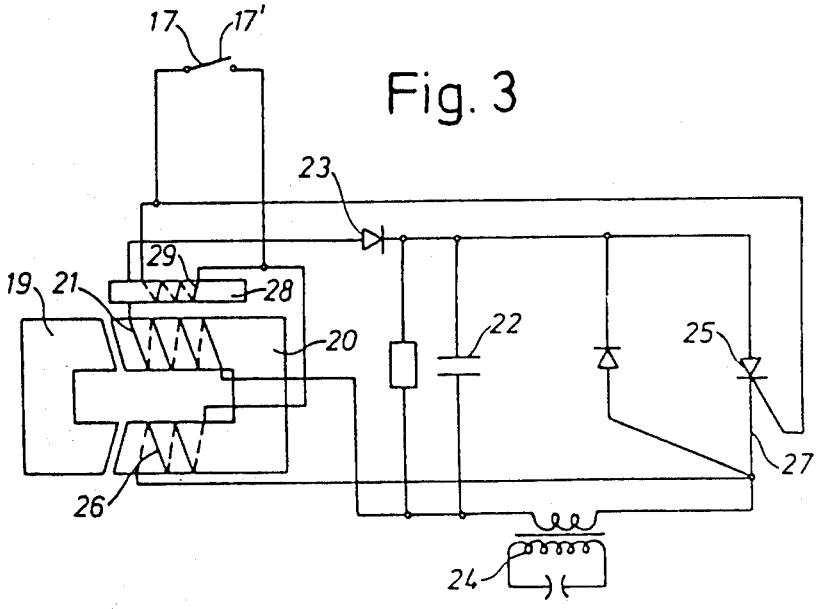
Figure 2:
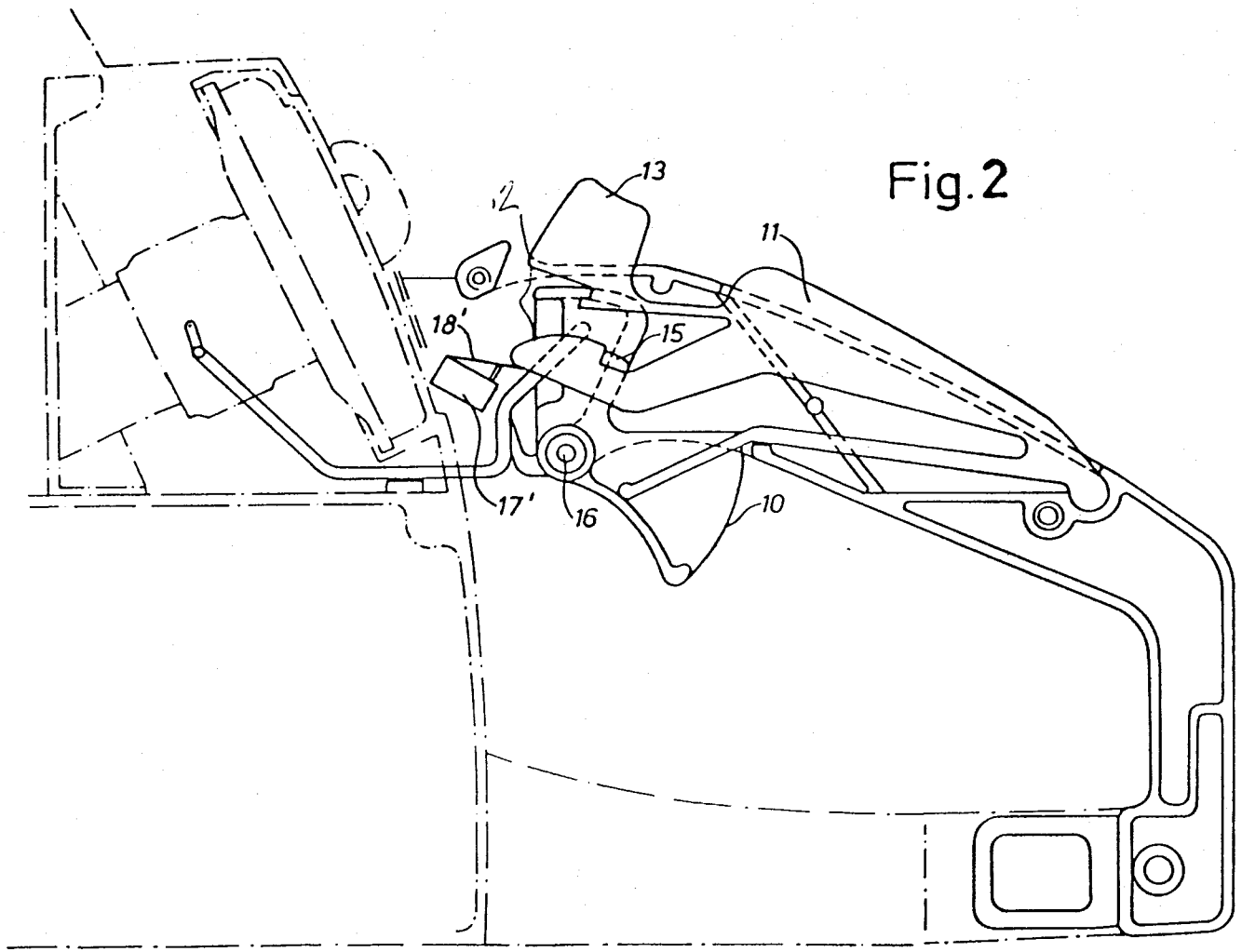

An embodiment of an arrangement according to the invention will be described in the following paragraphs with reference to the accompanying drawings, which FIG. 1 shows a handle with throttle control of an engine-driven tool (power saw), FIG. 2 shows a variation of the wiring the handle and in FIG. 3 is a wiring diagram of the arrangement.

The shown illustrated handle is the rear handle of a power saw and comprises inter alia a finger grip 10 for the control of a throttle (not shown), a handle grip in the form of a lever 11 with a pawl 12 for locking the finger grip in an idle position, generally called "a stop for unintentional speeding", and a start position knob 13 which also has a pawl 14. The pawls 12 and 14 co-operate with a nose 15 on the grip 10 journalled on a shaft 16 in the frame of the handle. When the grip 10 is rotated about the shaft 16 the nose 15 moves in a circular path into which the pawls 12 and 14 can be introduced or withdrawn by manual operation of the lever 11 and the knob 13, respectively. A complete description of the function of the pawls and the nose in several operational positions of the saw is given in published Swedish patent specification No. 7904657-9.

The start position knob 13, and alternatively the lever 11, is used for the actuation of a switch 17; 17' which is a part of the electric ignition system shown in FIG. 3.

When the start position knob 13 is depressed and the grip 10 set on start position, the grip is retained in this position in the manner shown in FIG. 1. The knob 13 has been pressed to its innermost position and in turn presses on a switch arm 18 of the switch 17, which is then actuated. In the alternative embodiment according to FIG. 2 the switch 17' is positioned at the pawl 12 of the lever 11 and is actuated via a switch arm 18' by the movements of the lever, so that it is kept in its one position when the lever is depressed and in the other position when the lever is raised.

FIG. 3 shows a wiring diagram of an ignition system designed in a conventional manner. A permanent magnet 19 is provided, e.g. in the flywheel of the engine, a fixed U-shaped iron core 20 has a charging winding 21 on one branch and, moreover, a capacitor 22 is connected via a diode 23 to the winding 21, an ignition coil 24 and an electronic switch (thyristor) 25. The other branch of the iron core carries a so-called trigger winding 26 provided for generating a control voltage for a control electrode 27 of the switch 25. In addition to the iron core 20 the system is provided with an iron rod 28 which has a regulation winding 29 and is disposed close to the core 20 so that the magnet 19 during its movement first passes this rod. The switch 17; 17' mentioned hereinbefore is connected in parallel with this winding 29. In the event that this switch is closed, which occurs when the start position knob 13 (FIG. 1) is raised (17 closed) or when the lever 11 (FIG. 2) is depressed (17' is closed), the system works as if the winding 29 did not exist. The capacitor 22 is charged via the diode 23 by the winding 21, and when the trigger winding supplies a positive voltage pulse the thyristor fires and a spark voltage is released from the ignition coil 24. This is the usual mode of working of an ignition system of the kind referred to. A complete description of this system is given in published Swedish patent specification No. 7314965-0.

In the event that the switch 17; 17' in the handle is open (actuated) both windings 26 and 29 co-operate in series in order to generate trigger pulses for the thyristor. The combined voltage from the two windings 26 and 29 is dependent on the r.p.m. of the engine so that the combined voltage, below a certain r.p.m., is too low for triggering the thyristor 25 since the voltage of the control pulse winding has still not risen sufficiently when the regulation winding 29 supplies its maximum value. When this happens the capacitor 22 is charged as usual and the spark is released when the trigger winding 26 supplies a trigger pulse. However, a higher r.p.m. of the engine results in a combined voltage from the windings 26, 29 which fire the thyristor 25, which then remains conducting during the time when the capacitor should be being charged. The charging current then passes through the thyristor and does not give any ignition pulse in the ignition coil, whereby the spark voltage fails. Hence the r.p.m. of the engine decreases and once again the combined voltage is insufficient for triggering, bringing about another charging of the capacitor and releasing a spark. In this way the r.p.m. is automatically controlled at a predetermined value as a result of the fact that ignition pulses are intermittently skipped and the engine thereby is prevented from increasing its r.p.m.

The advantage of controlling the r.p.m. in this way during the starting procedure has been stated in the introduction. If the switching r.p.m. of the centrifugal clutch is about 4000, the engine r.p.m. is suitably adjusted to about 3500. The engine is then prevented from speeding up by the switching r.p.m. of the centrifugal clutch during the starting procedure until the switch 17; 17' is actuated to closing position, as described hereinbefore. As an alternative, the switch 17' could be positioned in the carrying handle of the power saw, in which it is operated by the hand of the user in the same way as the switch 17' in the handle described.

The embodiment disclosed above shows how the invention can easily be practised. However, it should be noted that arrangements for limiting the r.p.m. are previously known and in some cases applicable to the purpose here described, e.g. centrifugal regulators, pressure indicators, frequency tunings etc. Thus, the invention should not be considered to be restricted to the example here illustrated but should be extended to the scope of the claims.

I claim:

1. In an arrangement in an i.c. engine having a spark ignition system for the control of the r.p.m. on start of the engine the engine having a hand operated retaining member for the throttle control which in a first position is positioned to retain the throttle control in a starting position, and a hand grip positioned in an operating handle for enabling operation of the engine, said hand grip being movable into active and inactive positions, respectively for enabling operation and disabling operation of the engine, respectively, the improvement wherein each of said retaining member and hand grip is positioned to open and keep open an electric switch connected in parallel with a regulating winding in the ignition system said regulating winding being positioned before a changing winding and a triggering winding, as seen in the direction of a movement of a magnetic field from the rotating magnet of the system, said regulating winding during the running of the engine above a predetermined r.p.m. in combination with the triggering winding supplying a control pulse to the ignition switch of the spark ignition system before the charging voltage has reached the value of ignition voltage for inhitibing the ignition spark, said hand grip opening and keeping open said switch when it is not positioned to enable operation of said engine, said retaining member opening and keeping open said switch in said first position.

2. An arrangement according to claim 1, wherein the said hand grip, comprises a stop inhibiting unintentional speeding.

3. An arrangement according to claim 1, wherein below the predetermined r.p.m. the regulation winding and the triggering winding do not supply control pulses before the charging voltage has reached the value of ignition voltage thereby so that a spark is released only by the triggering winding.

4. An arrangement according to claim 1, wherein said switch is closed when the retaining member is not in its first position or the hand grip is actuated to enable operation of said engine, thereby shunting the regulating winding.

5. An arrangement according to claim 1, wherein a centrifugal clutch connected to the engine has a switching r.p.m. which is higher than the said predetermined r.p.m. of the engine.

* * * * *